US006086697A

United States Patent [19]

Key

[11] Patent Number: 6,086,697

[45] Date of Patent: Jul. 11, 2000

[54] ROTATING LABEL SYSTEM AND METHOD

[75] Inventor: Stephen M. Key, Oakdale, Calif.

[73] Assignee: Stephen Key Design, LLC, Oakdale, Calif.

[21] Appl. No.: 09/126,010

[22] Filed: Jul. 29, 1998

[51] Int. Cl.[7] ..... B65C 3/08; G09F 3/00

[52] U.S. Cl. ..... 156/215; 156/DIG. 9; 40/306; 40/310; 40/506; 428/43; 428/343

[58] Field of Search ..... 156/212, 213, 156/215, 447, 475, DIG. 9, DIG. 10, DIG. 11, DIG. 12, DIG. 13, DIG. 18, DIG. 26, DIG. 34; 40/306, 310, 506; 428/41.7, 41.8, 43, 343

[56] References Cited

U.S. PATENT DOCUMENTS

| | | | |
|---|---|---|---|
| 736,035 | 8/1903 | Stevenson . | |
| 1,064,576 | 6/1913 | Washburn . | |
| 1,312,611 | 8/1919 | Chess . | |
| 1,334,031 | 3/1920 | Hahn | 40/335 |
| 1,387,625 | 8/1921 | Stein | 1/95 |
| 1,486,313 | 3/1924 | Van Antwerp . | |
| 2,013,616 | 9/1935 | Rettenmeyer | 220/1 |
| 2,129,364 | 9/1938 | Simons et al. | 283/8 |
| 2,441,607 | 5/1948 | Walls | 46/13 |
| 2,468,000 | 4/1949 | Taylor | 273/143 |
| 2,504,076 | 4/1950 | Lindblom | 40/68 |
| 2,844,893 | 7/1958 | Keller | 40/4 |
| 2,860,431 | 11/1958 | Barnum | 40/61 |
| 2,931,657 | 4/1960 | Lewis | 273/155 |
| 2,935,814 | 5/1960 | Freeze | 46/36 |
| 2,971,283 | 2/1961 | Parker | 40/334 |
| 3,278,182 | 10/1966 | Lescher | 272/8 |
| 3,374,911 | 3/1968 | White | 215/8 |
| 3,488,880 | 1/1970 | Taylor | 46/24 |
| 3,542,229 | 11/1970 | Beyerlein et al. | 215/1 |
| 3,604,584 | 9/1971 | Shank | 215/12 R |
| 3,733,002 | 5/1973 | Fujio | 215/12 R |
| 3,960,713 | 6/1976 | Carey | 206/534 |
| 4,044,889 | 8/1977 | Orentreich | 206/459 |
| 4,057,251 | 11/1977 | Jones et al. | 273/95 R |
| 4,203,240 | 5/1980 | Goodwin | 40/310 |
| 4,312,523 | 1/1982 | Haines | 40/306 X |
| 4,381,615 | 5/1983 | Lonsmin | 40/334 |
| 4,405,045 | 9/1983 | Villa-Real | 206/534 |
| 4,505,497 | 3/1985 | Katzman | 283/81 |
| 4,567,681 | 2/1986 | Fumei | 40/310 |
| 4,658,974 | 4/1987 | Fujita et al. | 215/12 R |
| 4,724,973 | 2/1988 | Shah | 215/246 |
| 4,844,760 | 7/1989 | Dickey | 156/215 |
| 4,877,119 | 10/1989 | Hosking | 206/459 |
| 5,076,613 | 12/1991 | Kovacs | 283/106 |
| 5,116,452 | 5/1992 | Eder | 156/566 |
| 5,154,448 | 10/1992 | Griffin et al. | 283/102 |
| 5,321,933 | 6/1994 | Seifert et al. | 53/415 |
| 5,324,559 | 6/1994 | Brombacher | 428/40 |
| 5,342,093 | 8/1994 | Weernink | 285/81 |
| 5,403,636 | 4/1995 | Crum | 428/40 |
| 5,639,529 | 6/1997 | Gozdecki et al. | 40/310 X |
| 5,800,893 | 9/1998 | Harden | 428/41.7 X |
| 5,809,674 | 9/1998 | Key | 40/306 |
| 5,884,421 | 3/1999 | Key | 40/306 |
| 5,953,170 | 9/1999 | Glancy | 40/310 X |

FOREIGN PATENT DOCUMENTS

| | | |
|---|---|---|
| 85214 | 3/1958 | Denmark . |
| 965522 | 9/1950 | France . |
| 1347102 | 11/1963 | France . |
| 2460260 | 1/1981 | France . |
| 285514 | 10/1988 | France . |
| 2677786 | 12/1992 | France . |
| 1565 | 6/1888 | Sweden . |

*Primary Examiner*—Curtis Mayes
*Attorney, Agent, or Firm*—Carr & Ferrell LLP

[57] ABSTRACT

A system and method are disclosed for constructing a rotatable label and attaching the rotatable label to a container. The rotatable label includes a release tab releasably attached to an outer label. The release tab is adhered to the container, or to an inner label adhered to the container, to secure the outer label to the container while the outer label is wrapped around the container. The release tab may then be detached from the outer label to permit the outer label to be rotated about the container. Longitudinal movement of the outer label relative to the container may be restricted by disposing the outer label between top and bottom label panels formed on the container. The outer label is preferably adapted with a transparent portion or window permitting viewing of indicia disposed therebehind.

34 Claims, 9 Drawing Sheets

ROTATING LABEL SYSTEM AND METHOD

BACKGROUND OF THE INVENTION

1. Field of the Invention

The present invention relates generally to rotatable labels, and more particularly to a system and method for constructing a rotatable label device.

2. Description of the Background Art

Most consumer product containers are labeled with various types of information, such as product directions for use, warnings, dosage amounts, ingredients, advertisements, artwork, and the like. This information normally takes the form of written indicia presented on a label wrapped around the container. In many instances, however, the available space on a single label is insufficient to display all the information a product manufacturer may wish to present.

To provide additional space for the presentation of information on a given container, it has been proposed that an outer label positioned around an inner label may be employed. The outer label typically has a transparent portion and, by rotating the outer label relative to an inner label attached to the container, the information on the inner label can be viewed through the transparent portion. Such a construction permits information to be presented on both the outer and inner labels, thus substantially increasing the available space upon which information may be presented.

Despite the advantages of having a rotating label on a container, it has been impractical to employ rotating labels, in most circumstances due, to the high cost and difficulty of applying such a rotating label to a container. One significant difficulty has been maintaining the rotating label in the proper position relative to the product container. Because outer labels are typically not adhered to either the container or the inner label, there is a tendency for these outer labels to slide longitudinally relative to the product container, and become partially or fully separated therefrom.

Another limitation of prior rotating label systems has been that the cost of applying rotating labels to containers (on a mass production scale) is prohibitive for many applications. Conventionally, labels are applied to containers by applying an adhesive to either the label or the container and then wrapping the label around the container to adhere the label to the container. This manner of application yields a label that is fixed, and not rotatable, relative to the container. This manner of application has, in the past, not been useful in mounting rotatable labels to containers because of the need for the rotatable label to rotate about, and not be permanently affixed to, the container.

Consequently, a need exists to provide a rotatable label system and method by which a rotatable label may be cost-effectively mounted on a container without preventing the label from being rotatable relative to the container. Additionally, a need exists to provide an effective manner of mounting a rotating label to a container utilizing conventional label application machinery. Moreover, another need exists to provide a rotatable label that may be longitudinally maintained on a container.

SUMMARY OF THE INVENTION

The present invention overcomes or substantially alleviates prior problems associated with the provision of a rotatable label. In general, a release tab is removably attached to a rotatable label to facilitate attachment of the label to a container. The release tab is adhered to the container, or to a label affixed to the container, to secure the label to the container while the label is wrapped around the container. The release tab is then detached from the label once the label is wrapped about the container to permit the label to rotate about the container. The label is advantageously positioned between label panels formed on the container to limit the longitudinal movement of the label relative to the container.

In one embodiment, the rotating label system includes an outer label with a release tab removably attached to the outer label by a perforated edge. Both the outer label and the release tab have an adhesive applied thereto. In this configuration, the release tab may be adhered to a container, or an inner label, while the outer label is wrapped around the container. Once the outer label is secured about the container, the release tab is then detached from the outer label along the perforated edge to permit the outer label to rotate about the container.

Moreover, a rotating outer label may be secured about a container in accordance with the present invention by providing an outer label having first and second ends and a release tab releasably attached to the first end. The release tab is then adhered to the container, or to an inner label affixed to the container, to removably couple the outer label to the container. The outer label is then wrapped around the container and the outer label second end is adhered to a front surface of the outer label to secure the outer label about the container. Lastly, the outer label is detached from the release tab to permit the outer label to rotate about the container.

The present systems and methods for securing a rotatable label about a container permit a rotatable label, or shell, to be cost-effectively attached to a container using conventional label application machinery. Additionally, by securing the rotatable label between top and bottom label panels, the longitudinal movement of the label on the container is limited, thus maintaining the label on the container. Other advantages and features of the present invention will be apparent from the figures and detailed description as set forth below.

DETAILED DESCRIPTION OF THE PREFERRED EMBODIMENT

Figure 1:
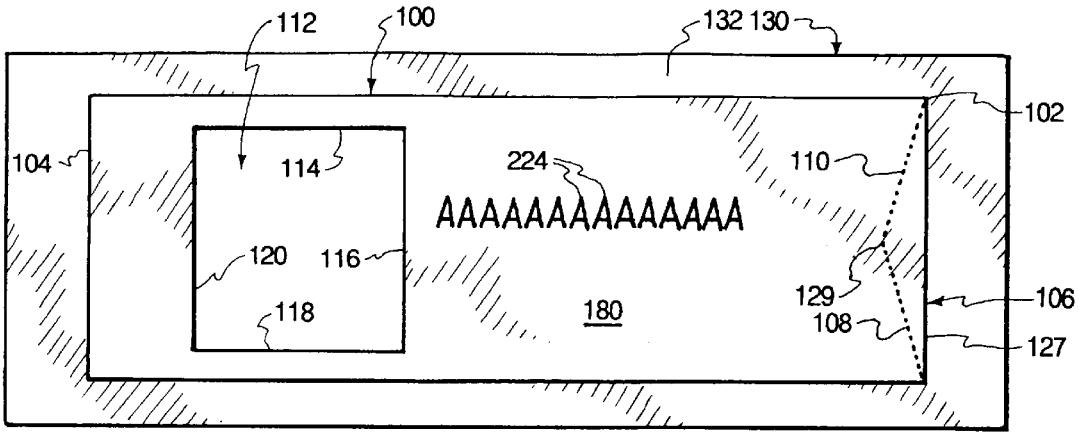
FIG. 1 is a side elevational view of a label according to the present invention.

FIG. 1 illustrates an outer label or shell 100 according to the present invention. As shown, the outer label 100 includes a first end 102 and a second end 104. A release tab 106 is removably attached to the label 100 at the first end 102 by a perforated attachment comprising perforated edges 108 and 110. In this configuration, the label 100 may be detached from the release tab 106 along the perforated edges 108 and 110 after being wrapped around a container as discussed below.

The outer label 100 also includes a transparent portion 112. The transparent portion 112 is illustrated as being defined by edges 114, 116, 118, and 120. The transparent portion 112 may include an open window with no material disposed between the edges 114–120. Alternatively, the transparent portion 112 may comprise a transparent film or the like to permit viewing through the transparent portion 112. As discussed in more detail below, the transparent portion 112 permits an exterior of an underlying container, or underlying label, to be viewed through the outer label 100.

A strip of adhesive 122 is shown as being disposed on a rear surface 124 of the outer label 100 adjacent to the label second end 104 and is further defined by an edge 128. Advantageously, with the exception of the strip of adhesive 122, the outer label 100 rear surface 124 is substantially non-adhesive. As is discussed in more detail below, the adhesive strip 122 secures the label second end 104 to the outer label front surface 180 to form a rotatable label when the outer label 100 is wrapped about an object, such as a container.

The release tab 106, as discussed above, is releasably attached to the outer label 100. In particular, the release tab 106 has a rear surface 126 with an adhesive applied thereon. The release tab 106 is used to couple the outer label 100 to a container, while the outer label 100 is being wrapped around the object. In this embodiment, the release tab 106 is advantageously shaped in a substantially triangular manner with a release tab back edge 127 being positioned opposite a release tab apex 129. As shown, the release tab apex 129 is located at the intersection of the perforated edges 108 and 110.

FIG. 1 illustrates the outer label 100 secured to a liner 130 to protect the adhesive strip 122 and the release tab adhesive rear surface 126 until just prior to the application of the outer label 100 to the object, such as a container. As shown, the adhesive strip 122 and the release tab adhesive rear surface 126 are adhered to a front surface 132 of the liner 130. In this configuration, the adhesive strip 122 and the adhesive surface 126 will not inadvertently adhere to anything other than the liner front surface 132 until the outer label 100 is ready to be applied to an object, such as a container. As discussed below, the liner 130 is peeled away from the label 100 and the release tab 106 just prior to applying the label to a container.

Figure 3:
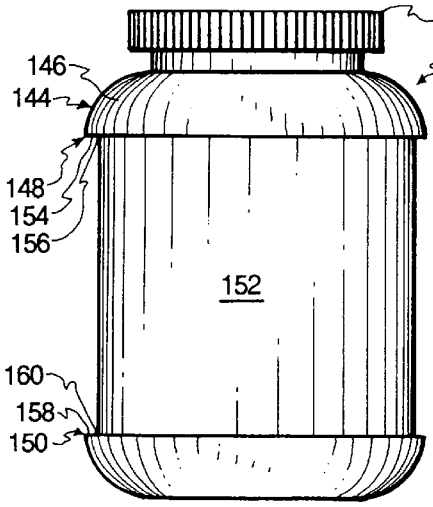
FIG. 3 illustrates a container having label panels in accordance with the present invention.

FIGS. 3–8 illustrate the application of the outer label 100 to a container 140. FIG. 3 shows the container 140 as having a cap 142 removably secured to a body 144. The base 144 has a exterior surface 146 that includes a top label panel 148, a bottom label panel 150, and a recessed surface 152 interposed between the top and bottom label panels. As discussed below, the outer label 100 is applied to the container 140 between the top label panel 148 and the bottom label panel 150. After the outer label 100 is secured about the container 140, the top and bottom label panels 148 and 150 limit the longitudinal displacement of the outer label 100 relative to the container 140. Limiting the longitudinal displacement of the outer label 100 on the container 140 prevents the outer label 100 from slipping off the container 140.

The top label panel 148, as shown in FIG. 3, includes a transverse annular edge 154 that intersects the recessed surface 152 along an annular comer 156. Similarly, the bottom label panel 150 includes a transverse annular edge 158 that intersects the recessed surface 152 along an annular comer 160. In this configuration, as discussed below, the label panels 148 and 150 limit longitudinal movement of the outer label 100 along the longitudinal axis of the container 140. In particular, the outer label 100 is maintained between the transverse edges 154 and 168 of the label panels 148 and 150.

Figure 4:
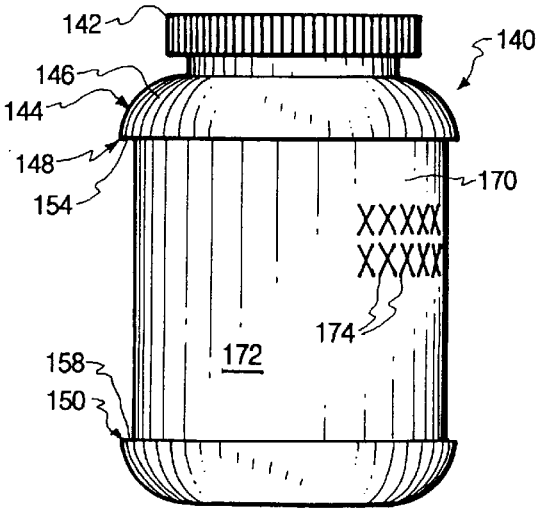
FIG. 4 illustrates the container of FIG. 3 having a fixed, non-rotatable label adhered thereto.

FIG. 4 illustrates the container 140 having a base label 170 affixed to the recessed surface 152 between the transverse edges 154 and 158 of the label panels 148 and 150 respectively. The base label 170 is shown as having a base label front surface 172 with written indicia 174 disposed thereon. The written indicia 174 may include text, graphics, artwork, and the like. Moreover, the information conveyed by the written indicia 174 may include product directions for use, warnings, dosage amounts, instructions, ingredients, nutritional data, advertisements, artwork, and the like.

Figure 2:
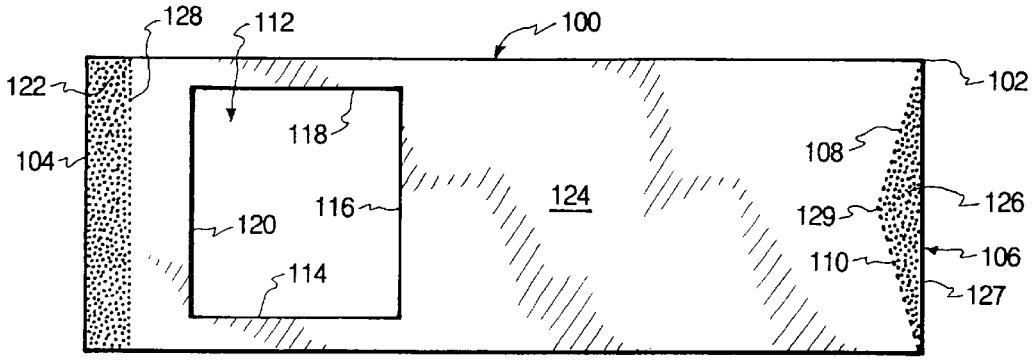
FIG. 2 is a side elevational view of the label of FIG. 1 secured to a liner.
Figure 5:
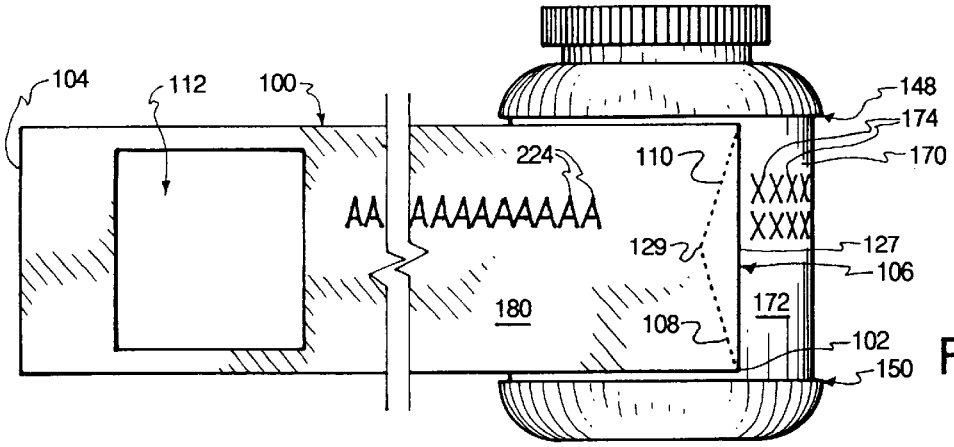
FIG. 5 illustrates the label of FIG. 1 coupled to the container of FIG. 3 in accordance with the present invention.

FIG. 5 shows the outer label 100 of FIGS. 1 and 2 coupled to the container 140 via the fixed label 170. Specifically, the adhesive rear surface 126 (FIG. 1) of the release tab 106 is adhered to the front surface 172 of the label 170 between the label panels 148 and 150. Advantageously, the release tab 106 is carefully positioned on the label front surface 172 so that the release tab 106 does not cover written indicia 174 disposed on the label front surface 172. In this manner, the label first end 102 is coupled to the container 140 while the outer label 100 is wrapped around and secured about the container 140, as discussed in more detail below.

Figure 6:
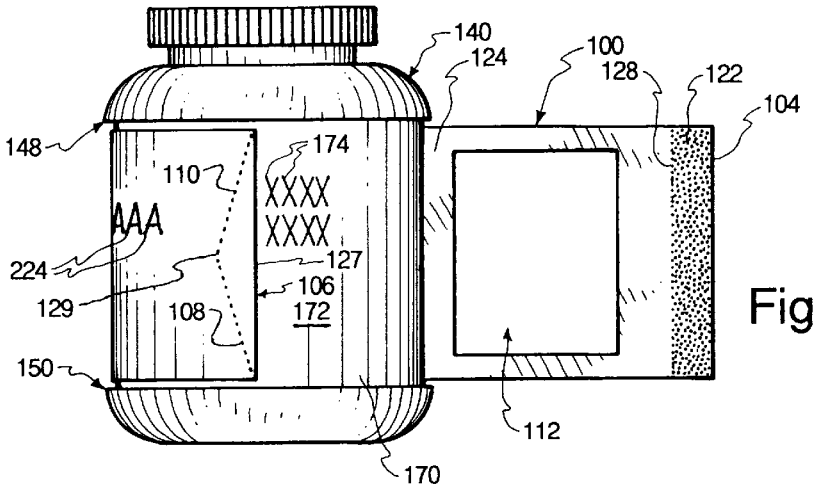
FIG. 6 illustrates the label of FIG. 1 partially wrapped about the container of FIG. 3 in accordance with the present invention.

FIG. 6 shows the outer label 100 partially wrapped around the container 140. As illustrated, the release tab 106 is adhered to the front surface 172 of the label 170 between the label panels 148 and 150. Preferably, the rear surface 124 of the outer label 100 is snugly positioned against the front surface 172 of the label 170. To enhance the ability of the outer label 100 to rotate relative to the label 170, a slip agent (not shown), such as a silicon-based slip agent, may be disposed between the label surfaces 124 and 172.

Figure 7:
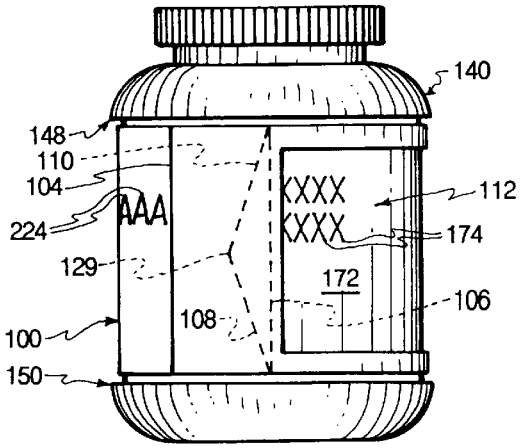
FIG. 7 illustrates the label of FIG. 1 secured about the container of FIG. 3 in accordance with the present invention.

FIG. 7 shows the outer label 100 secured about the container 140 with the second edge 104 of the outer label 100 adhered to a front surface 180 of the outer label 100. As shown, the adhesive strip 122 is adhered to the front surface 180 adjacent to the apex 129 of the release tab 106 (illustrated in phantom lines). In the configuration illustrated in FIG. 7, the outer label 100 is removably attached to the label 170 by the release tab 106. Specifically, the release tab 106 is releasably attached to the outer label 100 and adhered to the inner label 170. Hence, in this embodiment, for the outer label 100 to be rotatable relative to the inner label 170, the release tab 106 must be detached from the outer label 100.

Figure 8:
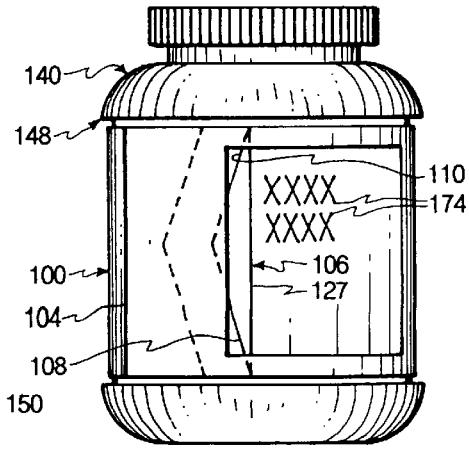
FIG. 8 illustrates the label of FIG. 1 rotatably mounted about the container of FIG. 3 in accordance with the present invention.

FIG. 8 shows the release tab 106 detached from the outer label 100 to permit the outer label 100 to rotate about the container 140 relative to the label 170. As shown, the release tab 106 is detached from the outer label 100 by rotating the outer label 100 relative to the label 170 and, thus, applying a tensile stress to the perforated edges 108 and 110. FIG. 8 shows the perforated edges 108 and 110 being broken by rotating the outer label 100 slightly clockwise, as viewed from above. By applying stress to the perforated edges 108 and 110, the perforated attachment fails and detaches the release tab 106 from the outer label 100. The release tab 106 remains adhered to the inner label 170.

In the configuration depicted in FIG. 8, the outer label 100 is not adhered to the label 170 or to the container and does not have the release tab 106 attached thereto and, as such, the outer label 100 is permitted to rotate relative to the label 170. Moreover, the outer label 100 is maintained longitudinally on the container 140 by the label panels 148 and 150. Consequently, the written indicia 174 on the underlying label front surface 172 can be viewed through the transparent window 112 by rotating the outer label 100 about the container 140.

FIGS. 9–14 illustrate another embodiment of the present invention. In this embodiment, an inner label or shell 200 is adhered to the outer label or shell 100 prior to application to the container 140. In this manner, both the inner label 200 and the outer label 100 may be mounted to the container at essentially the same time.

Figure 9:
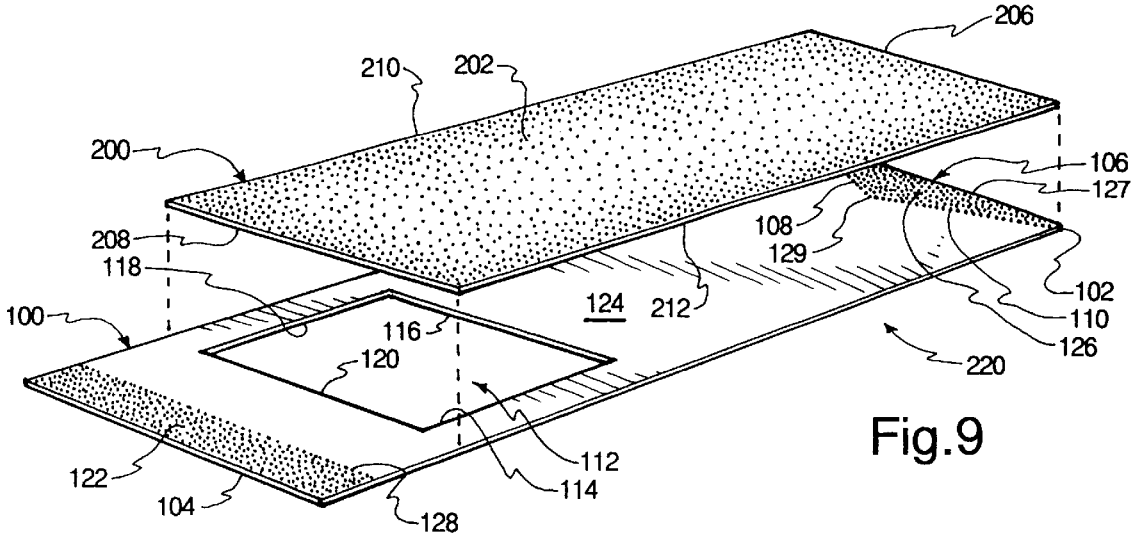
FIG. 9 is an exploded view of a two-layer label according to the present invention.
Figure 10:
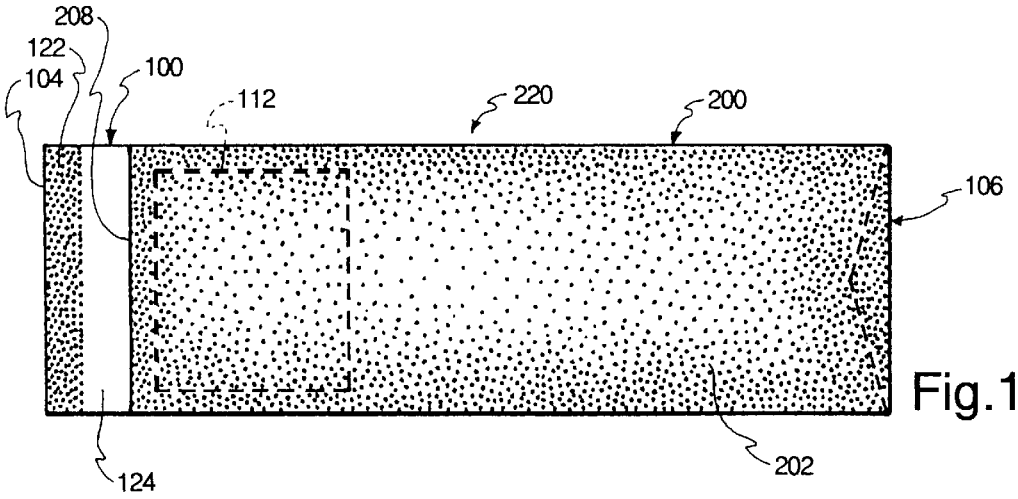
FIG. 10 is a side elevational view of the two-layer label of FIG. 9.
Figure 11:
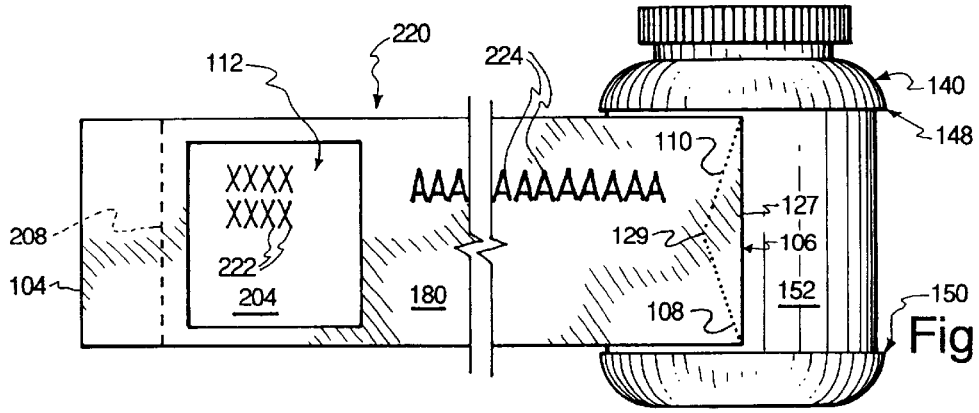
FIG. 11 illustrates the label of FIG. 10 attached to the container of FIG. 3 in accordance with the present invention.

In particular, and as shown in FIGS. 9, 10, and 11, the inner label 200 is a generally rectangular label having an adhesive rear surface 202 and a front surface 204 (FIG. 11). The inner label 200 is further defined by a first end 206, a second end 208, and top and bottom edges 210 and 212. As shown in FIG. 11, written indicia 222 is disposed on the label front surface 204.

In this embodiment, a two-layer label 220 is constructed by adhering the inner label front surface 204 (FIG. 1) to the adhesive rear surface 126 of the release tab 106. As such, the two-layer label 220 includes the inner label 200 attached to the outer label 100 by the release tab 106.

Figure 12:
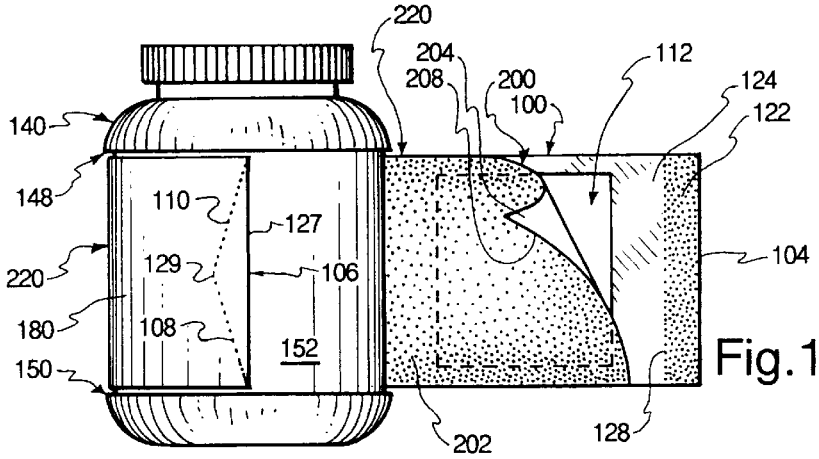
FIG. 12 illustrates the label of FIG. 10 partially wrapped around the container of FIG. 3 in accordance with the present invention.
Figure 13:
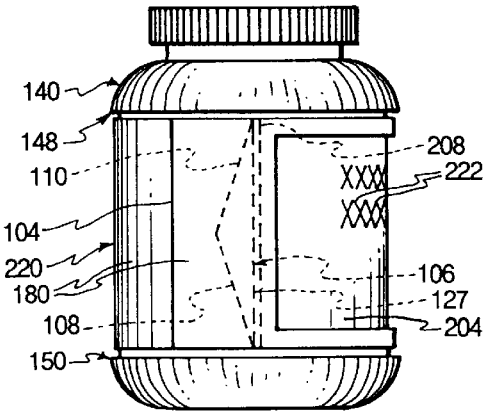
FIG. 13 illustrates the label of FIG. 10 secured about the container of FIG. 3 in accordance with the present invention.

FIG. 11 shows the two-layer label 220 adhered to the recessed surface 152 of the container 140. Specifically, the adhesive rear surface 202 (FIG. 10) of the inner label 200 is adhered to the container recessed surface 152 to secure the two-layer label 220 to the container 140. Adhering one end of the two-layer label 220 to the container 140, as illustrated in FIG. 11, facilitates wrapping the two-layer label 220 about the container 140 as illustrated in FIGS. 12 and 13. Additionally, FIG. 11 shows that the written indicia 222 disposed on the inner label front surface 204 may be seen through the transparent portion 112 of the outer label 100. Written indicia 224 is also disposed on the front surface 180 of the outer label 100.

FIG. 12 illustrates the two-layer label 220 partially wrapped around the container 140. Specifically, the adhesive rear surface 202 of the inner label 200 is adhered to the recessed surface 152 between the label panels 148 and 150 of the container 140. Because the outer label 100 is adhered to the inner label 200 via the release tab 106, the two-layer label 220 may be wrapped around the container 140 as a unitary piece.

FIG. 13 shows the two-layer label 220 secured about the container 140 with the outer label second end 104 adhered to the front surface 180 of the outer label 100. In particular, the adhesive strip 122 (FIG. 12) disposed on the outer label rear surface 124 is adhered to outer label front surface 180. The perforated edges 108 and 110 are illustrated in phantom as being positioned beneath the outer label.

Figure 14:
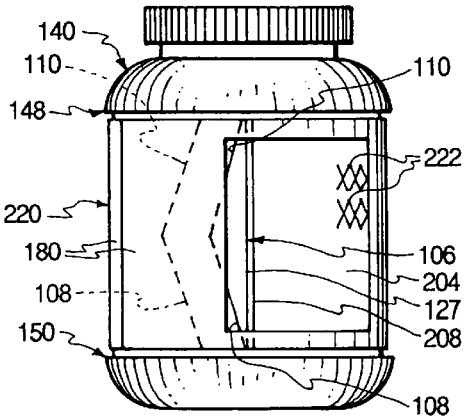
FIG. 14 illustrates the label of FIG. 10 rotatably mounted about the container of FIG. 13 in accordance with the present invention.

To separate the inner label 200 from the outer label 100, the outer label 100 is rotated relative to the inner label 200, as illustrated in FIG. 14. Rotating the outer label 100 relative to the inner label 200 breaks the release tab 106 away from the outer label 100 along the perforated edges 108 and 110 to permit the outer label to rotate about the container 140. In FIG. 14, the release tab 106 is shown through the window 112 as being separated from the outer label 100 and adhered to the inner label front surface 204. Thus, in the configuration illustrated in FIG. 14, the outer label 100 may rotate relative to the inner label 200 between the label panels 148 and 150 of the container 140.

Figure 15:
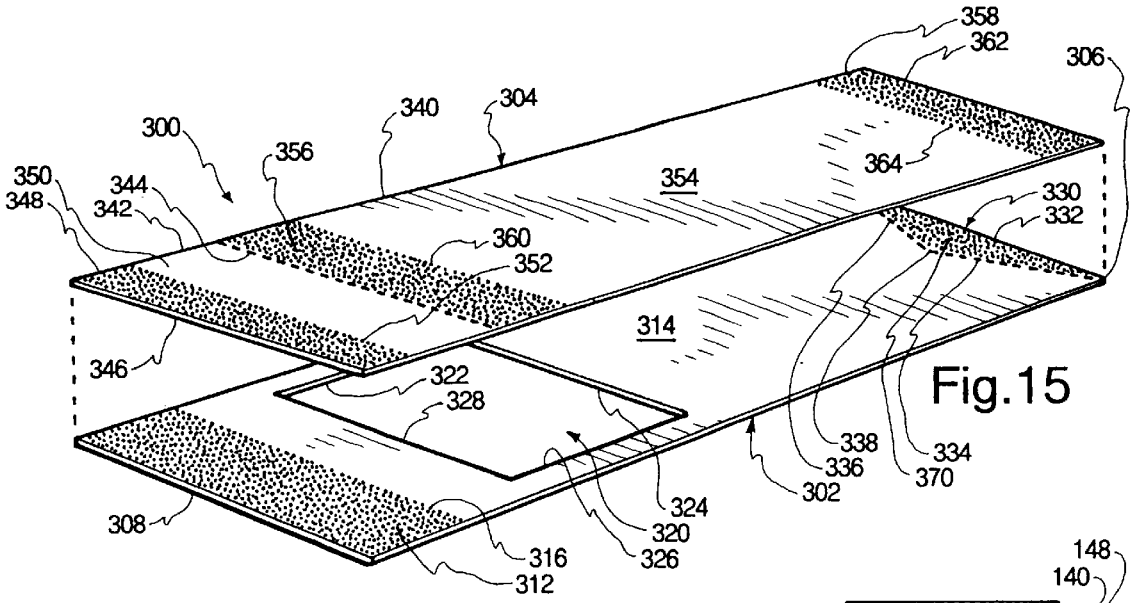
FIG. 15 is an exploded view of another embodiment of a two-layer label according to the present invention.

FIGS. 15–19 illustrate yet another embodiment of the present invention. In particular, FIG. 15 illustrates a two-layer label 300 having an outer label 302 and an inner label 304. As shown, the outer label 302 and the inner label 304 have substantially equal lengths and widths. Because the outer label 302 and the inner label 304 have substantially equal lengths, this embodiment is particularly useful in "cut and stack" and "roll fed" applications in which labels are cut and glued at essentially the same time. In "cut and stack" and "roll fed" applications, the labels are frequently arranged in series in long rolls and, therefore, it is advantageous that the inner and outer labels have substantially equal lengths. The "cut and stack" and "roll fed" label application methods are conventional and are well known to those skilled in the art.

In FIG. 15, the outer label 302 is shown as including a first end 306 and a second end 308. An adhesive strip 312 is disposed on an outer label rear surface 314 and is positioned adjacent to the second end 308. The adhesive strip 312 is further defined by an edge 316. A transparent window 320 is formed in the outer label 302 to permit the inner label 304 to be viewed through the transparent window 320. The transparent window 320 may be an opening in the outer label 302, or alternatively, a transparent portion of the outer label 302. The window 320 is shown as being further defined by edges 322, 324, 326, and 328.

Additionally, a release tab 330 is releasably attached to the outer label 302. The release tab 330 permits the outer label 302 to be coupled to the inner label 304 while the two-layer label 300 is being applied to a container. The release tab 330 also permits the inner label 304 to be detached from the outer label 302 to permit the outer label 302 to rotate relative to the inner label 304. In particular, the release tab 330 is shown in FIG. 15 as comprising a generally triangular member having a front edge 332 and perforated edges 334 and 336. Advantageously, the perforated edges intersect at an apex 338.

The inner label 304 is also illustrated in FIG. 15. The inner label 304 comprises a main label portion 340 and a release tab 342 removably attached to the main label portion 340 by a perforated edge 344. As shown, the release tab 342 has a back edge 346 positioned opposite the perforated edge 344. An adhesive strip 348 is disposed on a release tab rear surface 350 between the back edge 346 and an adhesive strip edge 352.

The main label portion 340 is shown as having a rear surface 354 with adhesive strips 356 and 358 disposed on either end thereof. Specifically, the adhesive strip 356 is shown as being positioned adjacent to the perforated edge 344 and is further defined by adhesive strip edge 360. The adhesive strip 358 is positioned on the rear surface 354 between an inner label first end 362 and an adhesive strip edge 364.

Figure 16:
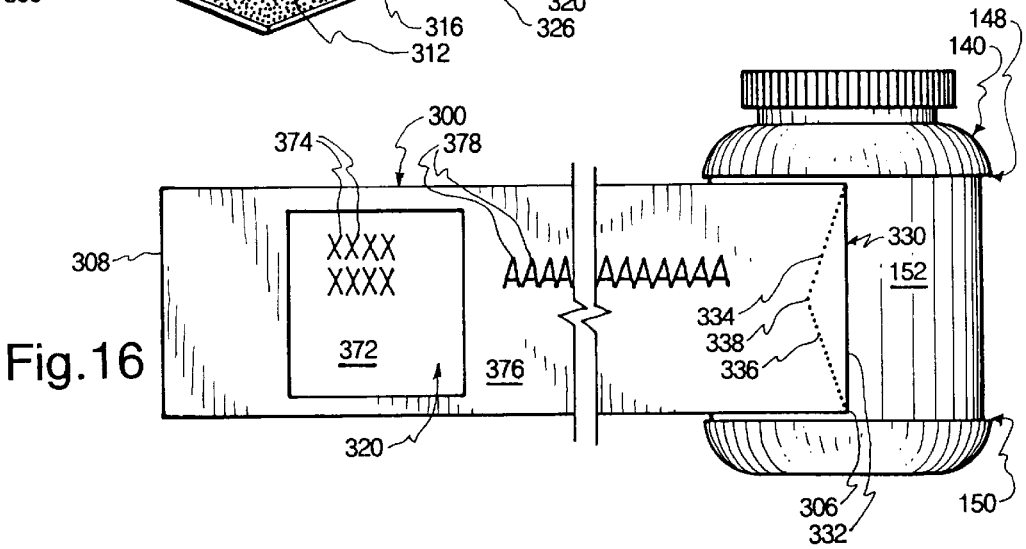
FIG. 16 illustrates the two-layer label of FIG. 15 attached to a container in accordance with the present invention.

As shown, the two-layer label 300 is constructed by adhering the outer label 302 to the inner label 304. The outer label 302 is adhered to the inner label 304 by adhering a release tab adhesive rear surface 370 to an inner label front surface 372 (FIG. 16). The outer label 302 is further secured to the inner label 340 by adhering the adhesive strip 312 to a front surface (not shown) of the inner label release tab 342. In this configuration, the outer label 302 and the inner label 304 are adhered to each other at both ends.

FIG. 16 illustrates the two-layer label 300 coupled to the container 140 in accordance with the present invention. Specifically, the inner label adhesive strip 358 (FIG. 15) is adhered to the recessed surface 152 of the container 140 between the top and bottom panels 148 and 150. Adhering the two-layer label 300 to the container 140 prior to wrapping the label 300 about the container 140 secures the label 300 to the container 140 and facilitates wrapping the label 300 about the container 140.

Additionally, as shown in FIG. 16, the inner label front surface 372 is shown as having written indicia 374 disposed thereon. Similarly, an outer label front surface 376 also has written indicia 378 disposed thereon. The inner label written indicia 374 may be viewed through the transparent window 320.

Figure 17:
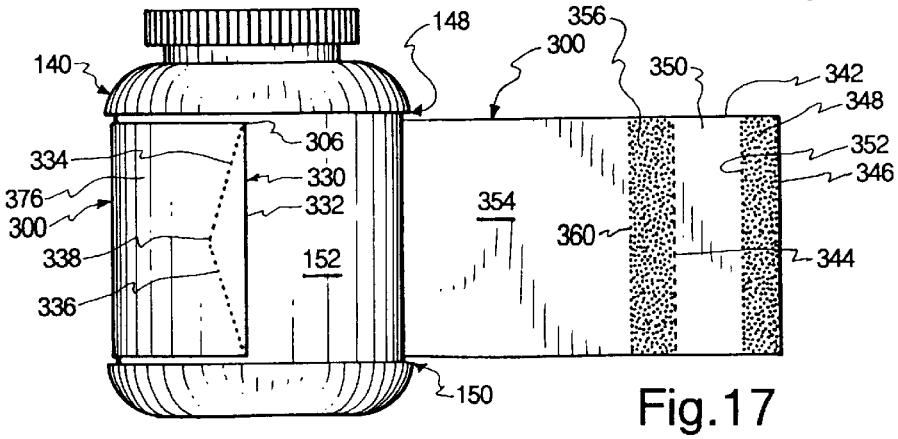
FIG. 17 illustrates the two-layer label of FIG. 16 partially wrapped around a container in accordance with the present invention.

FIG. 17 illustrates the two-layer label 300 partially wrapped about the container 140 between the label panels 148 and 150. The two-layer label 300 is partially wrapped about the container 140 by wrapping the label 300 from the position illustrated in FIG. 16 to the position illustrated in FIG. 17.

Figure 18:
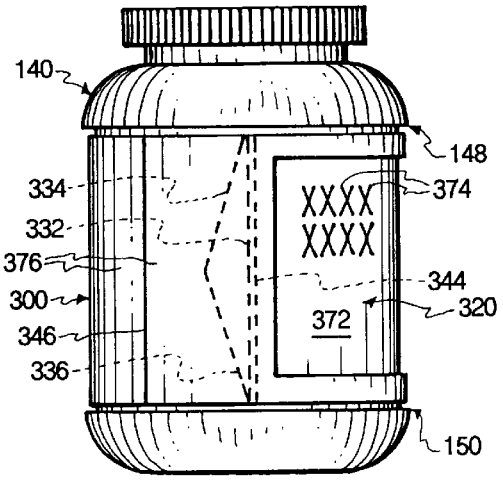
FIG. 18 illustrates the two-layer label of FIG. 16 secured about a container in accordance with the present invention.

The two-layer label 300 is then secured about the container 140 by adhering the adhesive strip 348 (FIG. 17) to the outer label front surface 376 as shown in FIG. 18. The adhesive strip 356 is adhered to the recessed surface 152 (FIG. 17). In FIG. 18, the release tab front edge 332 and the release tab perforated edges 334 and 336 are illustrated in phantom with the release tab 330 still releasably attached to the outer label 302. Likewise, the perforated edge 344 of the inner label is also shown in phantom and with the main label portion 340 removably attached to the release tab 342.

Figure 19:
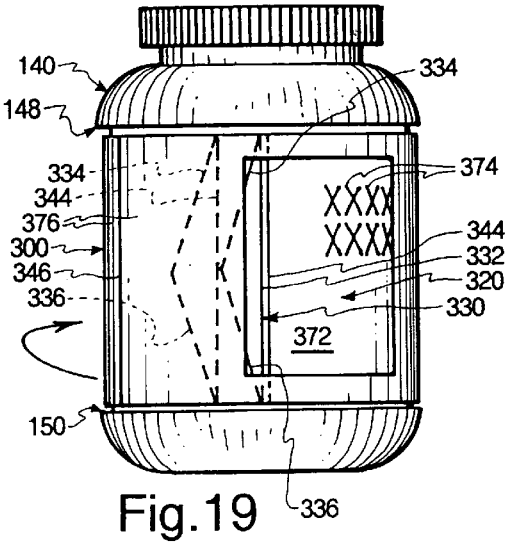
FIG. 19 illustrates the two-layer label of FIG. 16 with an outer layer being detached from an inner layer to permit the outer layer to rotate according to the present invention.

To separate the inner label 304 and the outer label 302, the outer label 302 is rotated from the position illustrated in FIG. 18 to the position illustrated in FIG. 19 to break the outer label 302 from the inner label 304 along the perforated edges 334, 336, and 344. More specifically, the release tab 330 is detached from the outer label 302 along the perforated edges 334 and 336. Similarly, the release tab 342 is detached from the main label portion 340 of the inner label 304 along the perforated edge 344. The release tab 342 remains adhered to the outer label rear surface 314 and the release tab 330 remains adhered to the inner label front surface 372. Hence, as shown in FIG. 19, the outer label 304 is rotatable relative to the inner label 302 and the container 140.

FIGS. 20–26 illustrate yet another embodiment of the present invention. These figures show a two-layer label 400 that includes an outer label, or shell, 402 and an inner label, or shell, 404. As show in FIGS. 20–25, the outer label 402 and the inner label 404 are removably attached along a perforated edge 406. In this embodiment, the outer and inner labels 402 and 404 are applied to the container 140 (FIGS. 22–26) by wrapping the two-layer label 400 about the container 140 twice. Once secured about the container 140, the outer and inner labels 402 and 404 are uncoupled to permit the outer label 402 to rotate relative to the inner label 404 and to form a two-layer label.

As illustrated, the inner label 404 includes a first edge 410, a front surface 412 (FIG. 21), and a rear surface 414. An adhesive is applied to the rear surface 414 to permit the inner label 404 to be adhered to the container 140 as discussed below. Moreover, as shown in FIGS. 20–25, the inner label 404 is releasably attached to the outer label 402 along the perforated edge 406.

Figure 25:
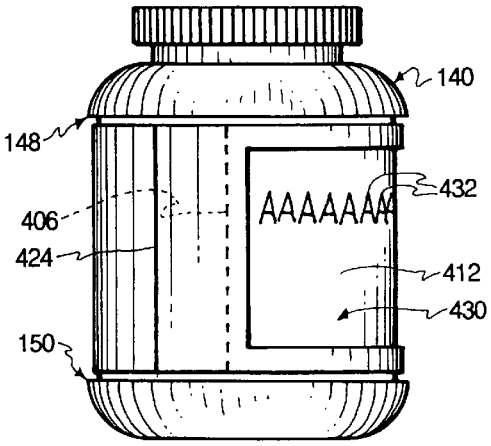
FIG. 25 illustrates the two-layer label of FIG. 20 secured about a container according to the present invention.
Figure 26:
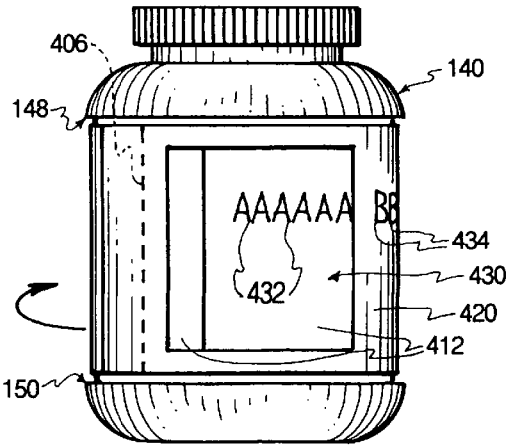
FIG. 26 illustrates the two-layer label of FIG. 20 with an outer layer detached from an inner layer to permit the outer layer to rotate in accordance with the present invention.

The outer label 402 is shown as having a front surface 420 (FIG. 21), a rear surface 422 (FIG. 20), and an edge 424 opposite the perforated edge 406. An adhesive strip 426 is disposed on the rear surface 422 adjacent to the edge 424 and is further defined by an edge 428. Further, in a manner similar to the embodiments discussed above, a transparent window 430 is formed in the outer label 402. The transparent window 430 may comprise an aperture within the outer label 402 or a transparent film so that the inner label front surface 412 may be viewed through the window 430, as shown in FIGS. 25 and 26.

Written indicia 432 is disposed on the inner label front surface 412. Similarly, written indicia 434 is disposed on the outer label front surface 420. By placing written indicia on both the inner and outer labels, the effective surface area for displaying written indicia on a given container is significantly greater than merely having written indicia placed on a single, non-rotatable label.

Figure 22:
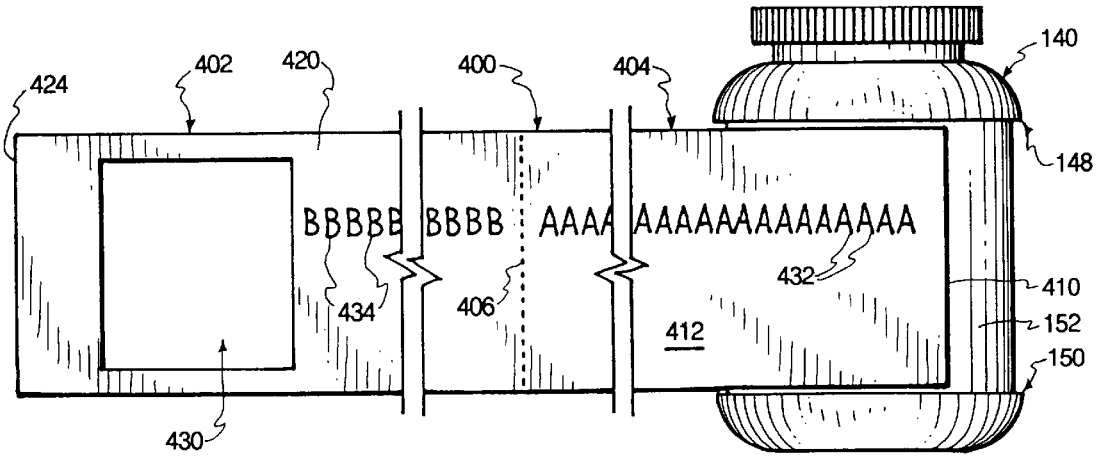
FIG. 22 illustrates the two-layer label of FIG. 20 attached to a container in accordance with the present invention.

The two-layer label 400 is secured about the container 140 as illustrated in FIGS. 22–26. Specifically, FIG. 22 shows the inner label 404 adhered to the container 140 between the label panels 148 and 150. In particular, the inner label rear surface 414 is adhered to the container recessed surface 152.

Figure 23:
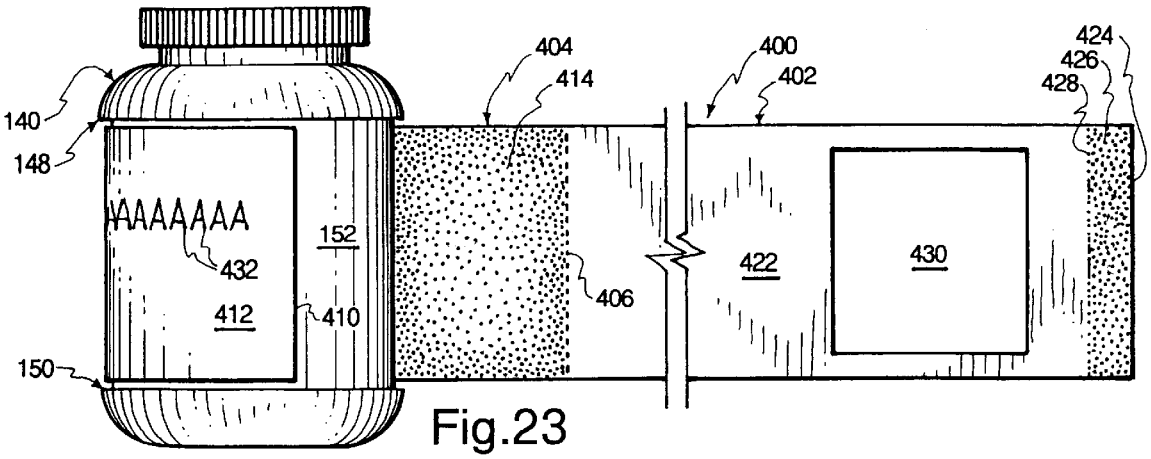
FIG. 23 illustrates the two-layer label of FIG. 20 partially wrapped around a container in accordance with the present invention.

The two-layer label 400 is then wrapped around the container 140 by wrapping the two-layer label 400 from the position shown in FIG. 22 to the position shown in FIG. 23. FIG. 23 shows the inner label 404 wrapped around, and adhered to, a substantial portion of the container 140.

Figure 24:
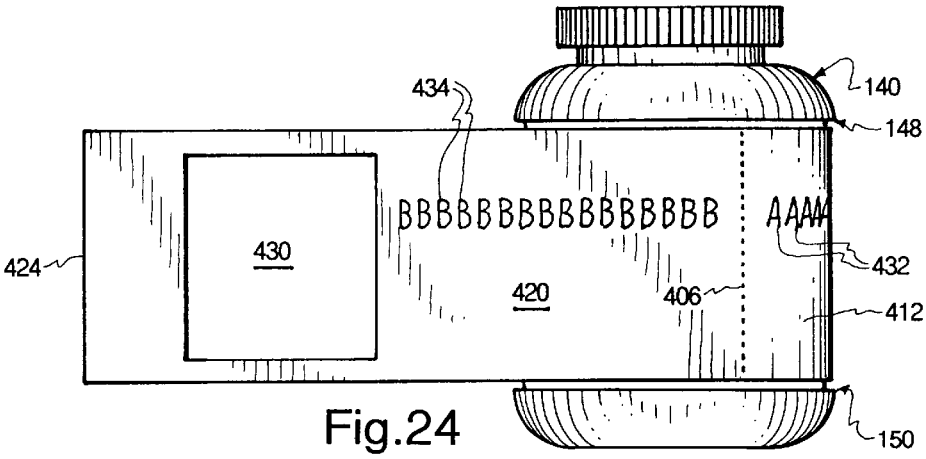
FIG. 24 shows an inner layer of the two-layer label of FIG. 20 wrapped around a container in accordance with the present invention.

Next, the entire inner label 404 is adhered to the container 140 by wrapping the two-layer label 400 from the position shown in FIG. 23 to the position shown in FIG. 24. In the configuration illustrated in FIG. 23, the inner label 404 is adhered about the container 140. To wrap the outer label 402 about the container 140, the label system 400 is wrapped from the position shown in FIG. 24 to the position illustrated in FIG. 25.

FIG. 25 shows the two-layer label 400 secured about the container 140. To secure the label system 400 around the container 140, the adhesive strip 426 (FIG. 23) is adhered to the outer label front surface 420. Preferably, in the configuration shown in FIG. 25, the adhesive strip 426 is not adhered to the perforated edge 406 (illustrated in phantom) to permit the outer and inner labels 402 and 404 to be disconnected, as discussed below in connection with FIG. 26.

FIG. 26 shows the outer label 402 uncoupled from the inner label 404. The outer and inner labels 402 and 404 are uncoupled by breaking the perforated edge 406 that releasably attaches the outer and inner labels 402 and 404. As illustrated, the perforated edge 406 may be broken by rotating the outer label 402 relative to the inner label 404. Because the inner label 404 is adhered to the container 140, rotating the outer label 402 relative to the inner label 402, subjects the perforated edge 406 to a substantial increase in tensile stress, which, in turn, causes the perforated edge 406 to fail. When the perforated edge 406 breaks, or fails, the outer label 402 becomes disconnected from the inner label 404 and is permitted to rotate about the container 140 and relative to the inner label 404 between the label panels 148 and 150.

Figure 27:
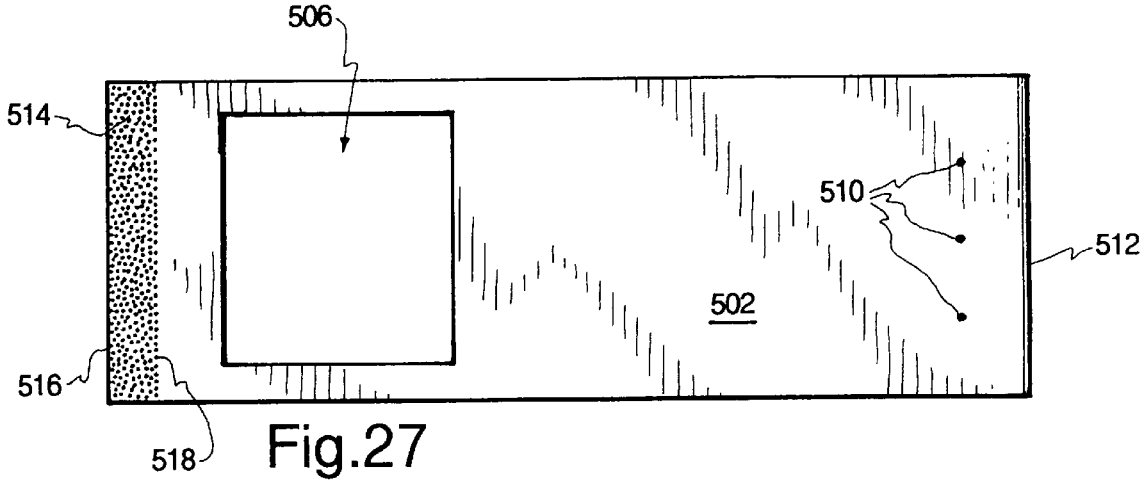
FIG. 27 is side elevational view of still another label according to the present invention.
Figure 28:
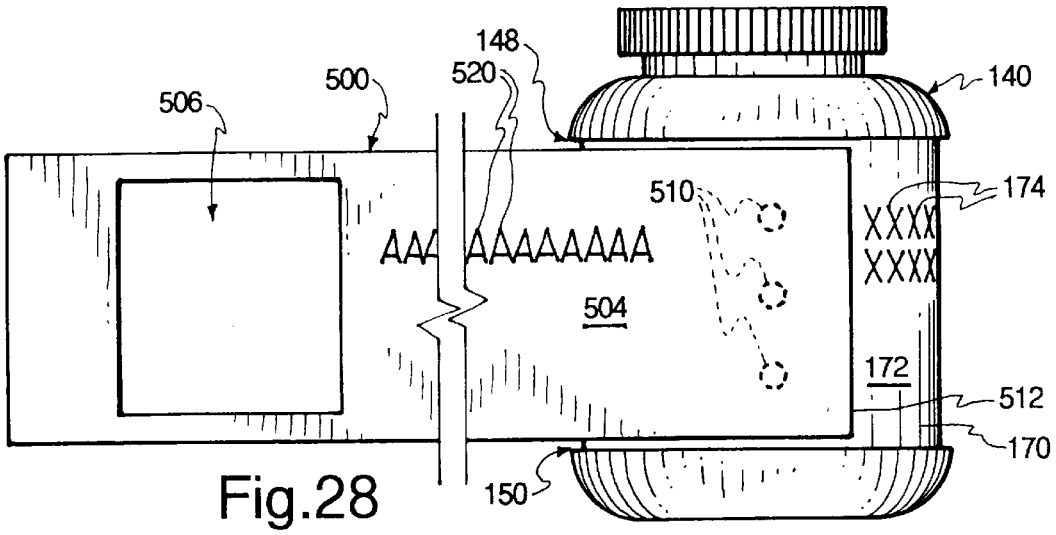
FIG. 28 illustrates the label of FIG. 27 adhered to the container of FIG. 4 in accordance with the present invention.

FIGS. 27–31 illustrate yet another embodiment of a rotatable label according to the present invention. Specifically, FIGS. 27 and 28 illustrate the outer label or shell 500 as having a rear surface 502, a front surface 504, and a transparent window 506. As shown, written indicia 520 is disposed on the outer label front surface 504. Glue droplets, or dots, 510 are disposed on the label rear surface 502 adjacent to a label first end 512 for temporarily adhering the outer label 500 to the inner label 170 as discussed below. An adhesive 514 is also disposed on the outer label rear surface 502 adjacent to an outer label second end 516 and is further defined by an edge 518. Preferably, with the exception of the glue dots 510 and the adhesive 514, the label rear surface 502 is substantially non-adhesive.

As shown in FIG. 28, the outer label 500 is temporarily adhered to the front surface 172 of the fixed inner label 170 by glue dots 510 to temporarily secure the outer label 500 to the container 140. Specifically, by adhering the outer label 500 to the inner label 170 with only the glue dots 510, the glue dots 510 act to temporarily secure the outer label 500 to the container 140 while the outer label 500 is wrapped and secured about the container 140. The glue dots 510 are configured to permit the outer label 500 to be detached from the inner label 170, once the outer label 500 is secured about the container 510, such that the outer label 500 may be rotated relative to the inner label 170 and the container 140 as discussed below. It should be understood that while FIG. 27 illustrates three glue dots 510 disposed on the outer label rear surface 502, different numbers, sizes, and shapes of glue dots may also be effectively employed.

Preferably, the glue dots 510 should be of sufficient number, size, and geometry to temporarily adhere the outer label 500 to the inner label 170 while the outer label 500 is wrapped around the container 140. The glue dots 510 should also permit the adhered connection of the outer label 500 and the inner label 170 along the dots 510 to be broken by rotating the outer label 500 relative to the inner label 170 as discussed below. To accomplish this result, a glue that has decreased adhesive strength over time, such as a time release glue, may be employed.

Figure 29:
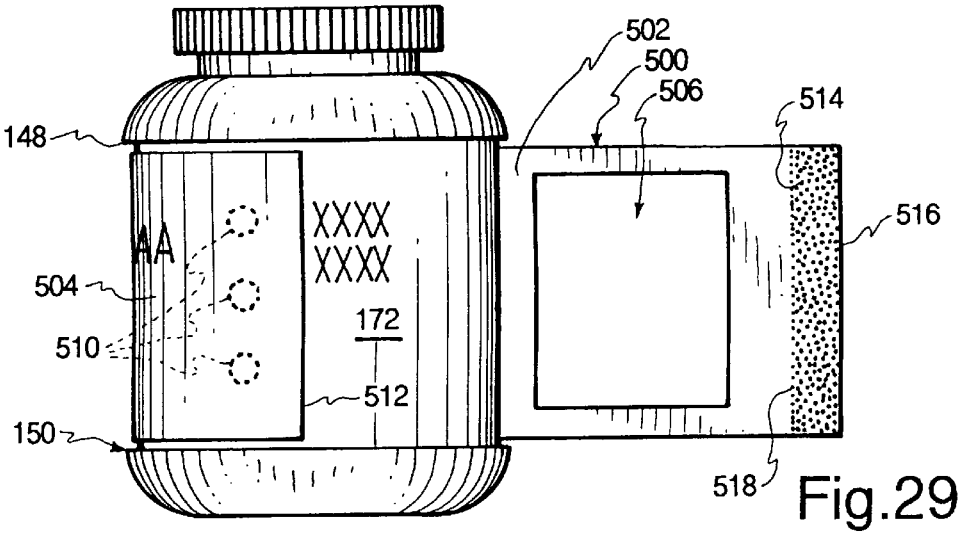
FIG. 29 illustrates the label of FIG. 27 partially wrapped about the container of FIG. 4 according to the present invention.

FIG. 29 illustrates the outer label 500 partially wrapped about the container 140. As shown, the glue dots 510 (illustrated in phantom) maintain the outer label 500 temporarily adhered to the inner label 170 and, thus, temporarily secured to the container 140. The outer label 500 is then moved from the position illustrated in FIG. 29 to the position illustrated in FIG. 30 to secure the outer label 500 about the container 140. In particular, the outer label rear surface 502 is adhered to the outer label front surface 504 by the adhesive 514 disposed on the outer label rear surface 502 to secure the outer label 500 about the container 140.

Figure 30:
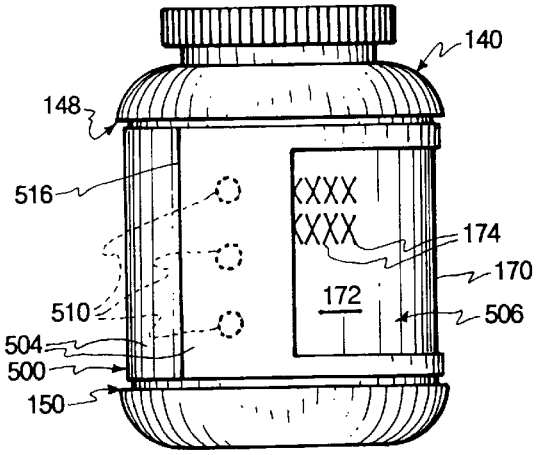
FIG. 30 illustrates the label of FIG. 27 secured about the container of FIG. 4 according to the present invention.
Figure 31:
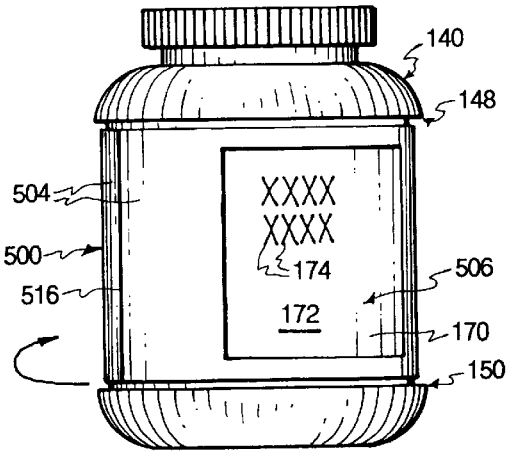
FIG. 31 illustrates the label of FIG. 27 rotatably mounted on the container of FIG. 4 in accordance with the present invention.
Figure 20:
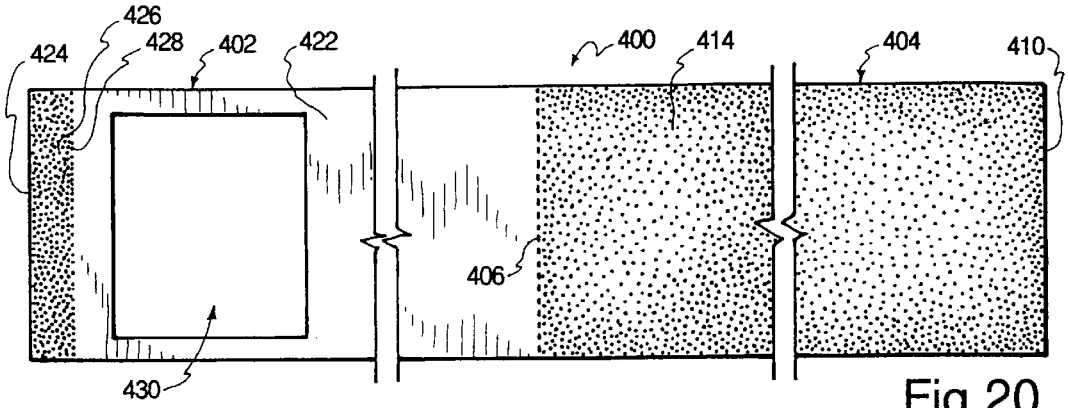
FIG. 20 is a side elevational view of yet another two-layer label according to the present invention.
Figure 21:
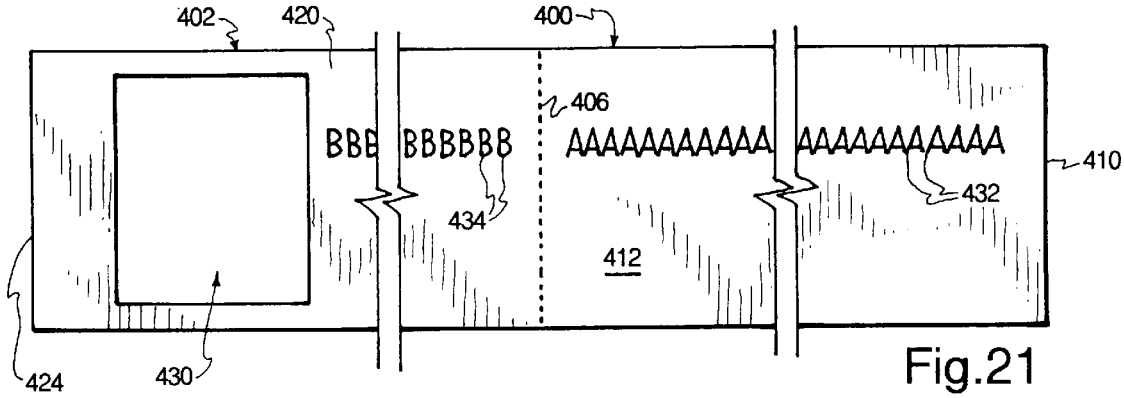
FIG. 21 is a side elevational view of the two-layer label of FIG. 20 according to the present invention.

With the outer label 500 secured about the container 140 as shown in FIG. 30, the outer label 500 is then rotated relative to the inner label 170 to detach the outer label 500 from inner label 170 to permit the outer label 500 to rotate about the container 140. Specifically, rotating the outer label 500 from the position shown in FIG. 30 to the position shown in FIG. 31 subjects the glue droplets 510 to shear stresses. These shear stresses cause the adhered connection of the inner label 170 to the outer label 500 to fail along the glue dots 510 to permit the outer label 500 to rotate relative to the inner label 170. By permitting the outer label 500 to rotate relative to the inner label 170, the written indicia 174 disposed on the inner label front surface 172 may be viewed through the transparent window 506.

The methods by which the embodiments described above may be secured about a container will now be discussed with reference to the drawings. With respect to the first embodiment, the outer label 100 is attached to the container 140 as shown in FIGS. 4–8. Initially, as illustrated in FIG. 4, the inner or base label 170 is adhered to the container recessed surface 152. As shown in FIG. 5, the adhesive rear surface 126 of the release tab 106 is then adhered to the inner label front surface 172 to couple the outer label to the container 140 via the inner label 170. In this configuration, the outer label 100 may be wrapped around the container 140 without the outer label first end 102 slipping relative to the inner label 170.

Next, as illustrated in FIGS. 6 and 7, the outer label 100 is wrapped around the container 140. Once the outer label 100 is wrapped around the container 140, the adhesive strip 122 is pressed against the outer label front surface 180 to attach, by adhesion, the outer label second end 104 to the label front surface 180. Lastly, the outer label 100 is rotated from the position illustrated in FIG. 7 to the position illustrated in FIG. 8 to detach the release tab 106 from the outer label 100 along the perforated edges 108 and 110.

Once the outer label 100 is detached from the release tab 106, the outer label may rotate about the container 140 between the label panels 148 and 150. The label panels 148 and 150 limit the longitudinal movement of the outer layer 100 and maintain the outer label 100 on the container 140.

The embodiment illustrated in FIGS. 9–14 is constructed and secured about a container as discussed below. First, the outer label 100 is adhered to the inner label 200 by adhering the release tab 106 to the inner label 200, as shown in FIGS. 9 and 10, to construct the two-layer label 220. Next, the two-layer label 220 is coupled to the container 140 as shown in FIG. 11. Specifically, the adhesive rear surface 202 (FIG. 10) is adhered to the recessed surface 152 of the container 140. Adhering an end of the two-layer label 220 to the container 140 prior to wrapping the two-layer label 220 about the container facilitates wrapping the two-layer label 220 about the container 140.

With one end of the two-layer label 220 adhered to container 140 as shown in FIG. 11, the two-layer label 220 is then wrapped about the container as shown in FIG. 12. In particular, the adhesive rear surface 202 of the inner label 200 is wrapped around and adhered to the recessed surface 152. Because the outer label 100 is adhered to the inner label 200, the outer label 100 is wrapped around the container 140 as the inner label 200 is wrapped around the container 140.

Next, the second end 104 of the outer label is adhered to the outer label front surface 180 to secure the outer label 100 about the container 140. Specifically, the outer label adhesive strip 122 is adhered to the outer label front surface 180. In this configuration, the outer label is secured about the container 140.

Lastly, the outer label 100 is rotated relative to the inner label 200 to separate the outer label 100 from the inner label 200. By rotating the outer label 100 relative to the inner label 200, the perforated edges 108 and 110 are subjected to relatively high stress. In turn, this high stress along the perforated edges 108 and 110 causes the release tab 106 to be broken away from the outer label 100 along the perforated edges 108 and 110 as shown in FIG. 14. In this configuration, the outer label 100 can be rotated relative to the inner label 200 to permit the length of the inner label front surface 204 to be viewed through the transparent window 112 by rotating the outer label 100 relative to the inner label 200.

As shown in FIG. 15, the two-layer label 300 is constructed by adhering the release tab adhesive surface 370 to the inner label front surface 372 (FIG. 16) and by adhering the outer label rear surface 314 to the inner label front surface 372 by the adhesive strip 312. In this configuration, the two-layer label 300 is constructed and ready to be applied to the container 140.

Once constructed, the two-layer label 300 is applied to the container 140, as shown in FIGS. 16–19. First, the inner label 304 is adhered to the recessed surface 152 of the container 140 between the label panels 148 and 150. The inner label 304 is adhered to the recessed surface 152 by the adhesive strip 358 disposed on the inner label rear surface 354.

Next, as shown in FIGS. 17 and 18, the two-layer label 300 is wrapped around and secured about the container 140. To wrap the two-layer label 300 around the container 140, the label 300 is moved from the position illustrated in FIG. 16 to the position illustrated in FIG. 17. The label 300 is then further wrapped around the container 140 by moving the label from the position illustrated in FIG. 17 to the position shown in FIG. 18. Once the label 300 is positioned as shown in FIG. 18, the adhesive strip 356 is adhered to the container recessed surface 152. Likewise, the adhesive strip 348 is adhered to the outer label front surface 376 to secure the two-layer label 300 around the container 140.

Lastly, the outer label 302 is disconnected from the inner label 304 to permit the outer label 302 to rotate relative to the inner label 304. In the configuration illustrated in FIG. 18, the outer label 302 is connected to the inner label by the adhesive strip 312 and by the adhesive rear surface 370 of the release tab 330. To disconnect the outer label 302 from the inner label 304, the outer label 304 is rotated from the position shown in FIG. 18 to the position shown in FIG. 19. By rotating the outer label 304 relative to the inner label 302, the inner label perforated edge 344 is broken. Likewise, the rotation also causes the release tab 300 to be detached from the outer label 304 along the perforated edges 334 and 336. Consequently, as shown in FIG. 19, with the outer label 304 separated from the inner label 302, the outer label 304 can rotate around the container 140 with the inner label release tab 342 adhered to the outer label 304 and with the outer label release tab 330 adhered to the inner label 302.

FIGS. 22–26 illustrate yet another method of mounting a rotating label system to a container according to the present invention. As shown in FIG. 22, the two-layer label 400 is adhered to the recessed surface 152 of the container 140 by the adhesive inner label rear surface 414. Next, the label system 400 is wrapped from the position shown in FIG. 22 to the position shown in FIG. 23 to substantially wrap the inner label 404 about the container 140.

The inner label 404 is then completely wrapped around the container 140 by wrapping the two-layer label 400 from the position illustrated in FIG. 23 to the position illustrated in FIG. 24. The outer label 402 is, then, wrapped about the container 140 and the inner label 404 by wrapping the two-layer label 400 from the position shown in FIG. 24 to the position shown in FIG. 25. The rear surface 422 of the outer label 402 is adhered to the outer label front surface 420 by the adhesive strip 426 to secure the two-layer label 400 about the container 140.

Lastly, the outer label 402 and the inner label 404 are disconnected along the perforated edge 406. As shown, disconnection of the outer label 402 from the inner label 404 is accomplished by twisting or rotating the outer label 404 relative to the inner label 402 to subject the perforated edge 406 to tensile stress. Due to the perforated nature of the perforated edge 406, a relatively small amount of force is required to cause the perforated edge to fail and break, thus disconnecting the outer and inner labels. With the outer label 402 disconnected from the inner label 404, the outer label 402 is free to rotate relative to the inner label 404 to permit the inner label written indicia 434 to be viewed through the transparent window 430.

FIGS. 28–30 illustrate a manner in which the outer label 500 may be applied to the container 140 according to the present invention. As shown in FIG. 28, the outer label 500 is first adhered to the inner label front surface 172 to temporarily secure the outer label 500 to the container 140. The outer label 500 is adhered to the inner label front surface 172 by the glue dots 510 (illustrated in phantom) disposed on the outer label rear surface 502. With the outer label 500 temporarily secured to the container 140, the outer label 500 is partially wrapped around the container 140 by moving the outer label 500 from the position shown in FIG. 28 to the position shown in FIG. 29.

Next, the outer label 500 is secured about the container 140 by moving the outer label 500 from the position shown in FIG. 29 to the position shown in FIG. 30. The outer label rear surface 502 is adhered to the outer label front surface 504 to secure the outer label 500 about the container 140.

Lastly, to permit the outer label 500 to rotate about the container 140, the outer label 500 is rotated relative to the inner label 170 to detach the outer label 500 from the inner label 170 along the glue dots 510. Specifically, the outer label 500 is rotated from the position shown in FIG. 30 to the position shown in FIG. 31 to impart shear forces to the glue dots 510. The glue dots 510, upon being subjected to these shear forces fail under the associated shear stresses to cause the outer label 500 to become detached from the inner label 170 and to rotate about the container 140 between the label panels 148 and 150. As shown, rotating the outer label 500 relative to the inner label 170 permits the written indicia 174 disposed along the length of the inner label 174 to be viewed through the window 506.

The invention has been described above with reference to specific embodiments. It will, however, be evident that various modifications and changes may be made thereto without departing from the broader spirit and scope of the invention as set forth in the appended claims. The foregoing description and drawings are, accordingly, to be regarded in an illustrative rather than a restrictive sense.

What is claimed is:

1. A method of labeling a container, comprising the steps of:

providing a container;

providing an outer label having a front surface and first and second ends;

providing a release tab releasably attached to the outer label adjacent to the outer label first end;

coupling the release tab to the container;

wrapping the outer label about the container; and attaching the outer label second end to the outer label front surface adjacent to the release tab to secure the outer label about the container.

2. A method according to claim 1, further comprising the step of detaching the release tab from the outer label to permit the outer label to rotate relative to the container.

3. A method according to claim 2, wherein the step of detaching further comprises rotating the outer label relative to the container.

4. A method according to claim 1, further comprising providing an inner label attached to the container, wherein the act of coupling further comprises adhering the outer label to the inner label.

5. A method according to claim 1 wherein the release tab is removably attached to the outer label by a perforated attachment.

6. A method according to claim 1, further comprising:

providing top and bottom label panels formed on an exterior surface of the container;

positioning the outer label between the top and bottom label panels to limit the longitudinal movement outer label relative to the container.

7. A method of labeling a container, comprising:

providing a container;

providing an inner label having first and second ends;

providing an outer label having a front surface and first and second ends;

providing a first release tab releasably attached to the outer label first end;

adhering the first release tab to the inner label adjacent to the inner label first end;

wrapping the inner label about the container; and attaching the outer label second end to the outer label front surface to secure the outer label about the container.

8. A method according to claim 7, further comprising detaching the first release tab from the outer label by rotating the outer label relative to the inner label.

9. A method according to claim 7 wherein the first release tab is removably attached to the outer label first end by a perforated attachment.

10. A method according to claim 7 wherein the container further comprises an exterior surface having top and bottom label panels formed thereon, the inner label being wrapped about the container between the top and bottom label panels.

11. A method of labeling a container, comprising:

providing a container;

providing an inner label having first and second ends;

providing an outer label having a front surface and first and second ends;

providing a first release tab releasably attached to the outer label first end;

providing a second release tab releasably attached to the inner label at the inner label second end;

adhering the first release tab to the inner label adjacent to the inner label first end to secure the inner label first end to the outer label first end;

adhering the second release tab to the outer label adjacent to the outer label second end to secure the inner label second end to the outer label second end;

wrapping the inner label about the container; and adhering the inner label second end to the outer label front surface to secure the outer label about the container.

12. A method according to claim 11, further comprising:

detaching the first release tab from the outer label;

detaching the second release tab from the inner label to permit the outer label to rotate relative to the inner label.

13. A method according to claim 11, further comprising rotating the outer label relative to the inner label to detach the first release tab from the outer label and to detach the second release tab from the inner label to permit the outer label to rotate relative to the inner label.

14. A method according to claim 11 wherein the container further comprises top and bottom label panels, further comprising wrapping the inner label about the container between the top and bottom label panels.

15. A method of applying a rotatable label to an object, comprising:

providing an object;

securing an inner label about the object;

temporarily coupling an outer label to the inner label while the outer label is wrapped about the object;

securing the outer label about the object;

detaching the outer label from the inner label to permit the outer label to rotate about the object.

16. The method according to claim 15, wherein the step of temporarily coupling further comprises adhering a dot of glue disposed on an rear surface of the outer label to a front surface of the inner label.

17. The method according to claim 15, wherein the step of detaching further comprises rotating the outer label relative to the inner label.

18. The method according to claim 15 wherein the step of detaching follows the step of securing.

19. The method according to claim 15 wherein the step of temporarily coupling further comprises temporarily adhering the outer label to the inner label while the outer label is wrapped about the object.

20. A rotatable label for application to an object, comprising:

a first shell having front and rear surfaces;

a second shell having front and rear surfaces;

a release tab releasably attached to the first shell, the release tab having a rear surface with an adhesive applied thereon, the release tab being adhered to the second shell front surface to releasably attach the first and second shells; and an adhesive disposed on the second shell rear surface for attaching the second shell to an object.

21. A rotatable label according to claim 20 wherein the second shell further comprises written indicia disposed on the second shell front surface.

22. A rotatable label according to claim 20, further comprising:

written indicia disposed on the second shell front surface;

a transparent portion formed in the first shell, wherein the written indicia disposed on the second shell front surface may be viewed through the transparent portion.

23. A rotatable label according to claim 20, wherein the first shell further comprises an adhesive on the first shell rear surface for adhering an end portion of the first shell rear surface to a corresponding end portion of the first shell front surface such that the first shell is secured about the object.

24. A rotatable label according to claim 20 wherein the release tab is removably attached to the first shell by a perforated attachment.

25. A rotating label system, comprising:

a container having top and bottom label panels with a recessed surface disposed between the top and bottom label panels;

a shell having front and rear surfaces, the shell rear surface having an adhesive disposed thereon for adhering the shell rear surface to the shell front surface to secure the first shell about the container between the top and bottom label panels; and a release tab releasably attached to the shell, the release tab having a rear surface coupled to the container recessed surface between the top and bottom label panels for releasably attaching the shell to the container while the shell is wrapped around the container, the release tab being thereafter detachable from the shell to permit the shell to rotate about the container.

26. A rotating label system according to claim 25 wherein the shell further comprises a transparent window.

27. A rotating label system according to claim 11 wherein the release tab is removably attached to the shell by a perforated edge.

28. A rotating label system according to claim 25 wherein the shell front surface has written indicia disposed thereon.

29. A two-layer label, comprising:

an outer shell having front and rear surfaces and first and second ends;

a first release tab releasably attached to the outer shell adjacent to the outer shell first end, the first release tab having front and rear surfaces;

a inner shell having front and rear surfaces and first and second ends, the inner shell front surface being adhered to the first release tab rear surface for removably coupling the outer shell to the inner shell at the inner shell first end; and a second release tab removably attached to the inner shell adjacent to the inner shell second end, the second release tab being adhered to the outer shell for releasably coupling the inner shell to the outer shell at the outer shell second end.

30. A two-layer label according to claim 29 wherein the outer shell further comprises a transparent window.

31. A two-layer label according to claim 29 wherein the inner shell and the outer shell may be detached from each other by detaching the first release tab from the outer shell and by detaching the second release tab from the inner shell.

32. A two-layer label according to claim 29 wherein the outer shell and the inner shell comprise substantially equal lengths.

33. A two-layer label according to claim 29 wherein the outer shell front surface has written indicia disposed thereon and the inner shell front surface has written indicia disposed thereon.

34. A two-layer label according to claim 29 wherein the first release tab is removably attached to the outer shell by a perforated edge and the second release tab is removably attached to the inner shell by a perforated edge.

* * * * *